US010869558B2

(12) United States Patent
Liran et al.

(10) Patent No.: US 10,869,558 B2
(45) **Date of Patent: *Dec. 22, 2020**

(54) FUNCTIONALLY SUPPORTIVE PILLOWS AND METHODS OF PREPARATION THEREOF

(71) Applicants: Giora Liran, Nashua, NH (US); Eyal Levy, Nashua, NH (US)

(72) Inventors: Giora Liran, Nashua, NH (US); Eyal Levy, Nashua, NH (US)

(73) Assignee: YOGIBO LLC, Nashua, NH (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/159,941

(22) Filed: Oct. 15, 2018

(65) Prior Publication Data

US 2019/0045941 A1 Feb. 14, 2019

Related U.S. Application Data

(63) Continuation of application No. 14/555,572, filed on Nov. 26, 2014, now Pat. No. 10,098,475.

(60) Provisional application No. 61/910,031, filed on Nov. 27, 2013.

(51) Int. Cl.

| | |
|---|---|
| ***A47C 27/08*** | (2006.01) |
| ***A47C 7/14*** | (2006.01) |
| ***A47G 9/10*** | (2006.01) |
| ***A47G 9/00*** | (2006.01) |

(52) U.S. Cl.

CPC ..... *A47C 27/086* (2013.01); *A47C 7/14* (2013.01); *A47G 9/007* (2013.01); *A47G 9/10* (2013.01); *A47G 2009/1018* (2013.01)

(58) Field of Classification Search

CPC ..... A47G 9/10; A47G 9/1054; A47G 9/1063; A47G 9/1072; A47G 9/1081; A47G 9/109; A47G 2009/1018

See application file for complete search history.

(56) References Cited

U.S. PATENT DOCUMENTS

| | | | | | |
|---|---|---|---|---|---|
| 3,899,797 | A * | 8/1975 | Gunst | A47O 4/54 | 297/452.41 |
| 4,011,611 | A * | 3/1977 | Lederman | A47C 3/16 | 273/DIG. 2 |
| 4,179,158 | A * | 12/1979 | Flaum | A47C 3/16 | 297/248 |
| 4,606,087 | A * | 8/1986 | Alivizatos | A47C 27/086 | 190/2 |
| 4,875,732 | A * | 10/1989 | Miller | A47C 3/16 | 297/181 |

(Continued)

FOREIGN PATENT DOCUMENTS

| | | |
|---|---|---|
| JP | 2003135191 | 5/2003 |
| JP | 2003245167 | 9/2003 |
| WO | 1987007126 A1 | 12/1987 |

*Primary Examiner* — Robert G Santos
*Assistant Examiner* — Rahib T Zaman
(74) *Attorney, Agent, or Firm* — JWIP & Patent Services, LLC; Jacob G. Weintraub, Esq.

(57) ABSTRACT

The present invention is directed to a functionally supportive pillow comprising a dynamically responsive combination of an inner core enclosing a bead material and an outer shell, such that the combination of the inner core with the outer shell creates a dynamic response to applied pressure to the pillow for increased functional support of said pillow.

20 Claims, 3 Drawing Sheets

(56) References Cited

U.S. PATENT DOCUMENTS 5,002,014 A * 3/1991 Albin ..... A01K 1/0353 119/28.5
5,733,012 A * 3/1998 Jones ..... A47C 3/16 297/284.1
5,778,470 A * 7/1998 Haider ..... A47G 9/10 5/644
5,845,352 A * 12/1998 Matsler ..... A47C 7/021 5/654
5,987,674 A * 11/1999 Schaffner ..... A47C 20/021 5/630
6,024,407 A * 2/2000 Eakin ..... A47C 3/16 297/217.4
6,052,848 A * 4/2000 Kelly ..... A47C 20/021 5/630
6,899,387 B2 * 5/2005 Ariizumi ..... A63H 3/02 297/181
7,793,371 B1 * 9/2010 Leach ..... A47C 20/021 5/630
8,336,964 B2 * 12/2012 Cho ..... A47C 3/16 297/452.17
10,098,475 B2 * 10/2018 Liran ..... A47C 27/086
2003/0192123 A1 * 10/2003 Chaffee ..... A47C 4/54 5/655.3
2003/0200609 A1 * 10/2003 Jusiak ..... A47C 27/086 5/655.4
2006/0042012 A1 * 3/2006 Littlehorn ..... A47C 20/021 5/632
2007/0151031 A1 * 7/2007 Leach ..... A47C 20/021 5/632
2009/0126117 A1 * 5/2009 Lazarus ..... A47G 9/0253 5/644
2009/0188043 A1 * 7/2009 Kirch ..... A47G 9/10 5/643
2010/0175192 A1 * 7/2010 Aiken ..... A47C 20/021 5/632
2010/0306923 A1 * 12/2010 Navan ..... A47G 9/0207 5/652.1
2013/0198962 A1 * 8/2013 Melcher ..... A47C 20/00 5/652
2013/0232691 A1 * 9/2013 Saul ..... A47G 9/10 5/632
2014/0248481 A1 * 9/2014 Curos Santaeularia .. B32B 5/04 428/219
2014/0265515 A1 * 9/2014 Harter ..... A47C 27/086 297/452.17
2015/0000042 A1 * 1/2015 Randall ..... A47G 9/10 5/655.4
2015/0028632 A1 * 1/2015 McNae ..... A47C 3/16 297/130
2015/0035324 A1 * 2/2015 George, II ..... A47C 27/086 297/188.01

* cited by examiner

Technical Back

Technical Face

FUNCTIONALLY SUPPORTIVE PILLOWS AND METHODS OF PREPARATION THEREOF

RELATED APPLICATIONS

This application is a Continuation of U.S. application Ser. No. 14/555,572, filed Nov. 26, 2014, which claims the benefit of priority from U.S. Provisional Patent Application No. 61/910,031, filed on Nov. 27, 2013; the entirety of each of which is incorporated herein by reference.

BACKGROUND OF THE INVENTION

The balance of comfort and support has been the long sought after goal in furniture design. Evolution of sofas, chairs, accessory pieces, and pillows have all been geared towards increasing the comfort of the user enjoying the furniture while retaining sufficient support. Although comfort is a subjective quality, generally comfort may be established by increasing the body conformance of the furniture item.

Ordinary cushions and pillows fail to provide this necessary support and structural integrity. Moreover, the original bean bag chairs attempted, but failed to provide sufficiently increased support to the concept of a pillow. While many further attempts have since been made to improve the original bean bags with increased support while maintaining the comfort of a pillow, none have succeeded in creating a durable functionally supportive pillow. As such, there is a need for durable and comfortable functionally supportive pillows that retain the comfort of a pillow, yet offer the increased support to the user.

SUMMARY OF THE INVENTION

The present invention provides a novel and inventive functionally supportive pillow afforded solely by the combination of specific elements as described herein, which afford a uniquely increased body conforming and ergonomically supporting pillow that may be used in various configurations, e.g., sitting, lying, and reclining, etc. In particular, the present invention is directed to a functionally supportive pillow comprising a dynamically responsive combination of an inner core enclosing a bead material and an outer shell, such that the combination of the inner core with the outer shell creates a dynamic response to applied pressure to the pillow for increased functional support of said pillow.

Accordingly in one aspect, the present invention provides a functionally supportive pillow comprising a dynamically responsive combination of an inner core enclosing a bead material and an outer shell, wherein (a) the inner core is defined by a first fabric material shaped into a pre-defined form capable of enclosing the bead material, wherein said first fabric consists of one or more synthetic fibers engineered to be stretchy and durable, which may be optionally treated to functionalize;

(b) the outer shell is defined by a second fabric shaped to contain the inner core enclosing the bead material, wherein said second fabric comprises one or more fibers engineered to be stretchy and durable;

(c) the bead material comprises a plurality of rounded particulates of polymeric foam capable of free flowing movement in the absence of constant pressure applied to the pillow, and wherein the inner core is disposed inside of the outer shell, such that the combination of the inner core with the outer shell creates a dynamic response to applied pressure to the pillow for increased functional support of said pillow.

In another aspect, the present invention provides an environmentally resistant (ER) functionally supportive pillow comprising a dynamically responsive combination of an inner core enclosing a bead material and an outer shell, wherein (a) the inner core is defined by a first fabric material shaped into a pre-defined form capable of enclosing the bead material, wherein said first fabric consisting of one or more synthetic fibers engineered to be stretchy and durable, which may be optionally treated to functionalize;

(b) the outer shell is defined by a laminated second fabric shaped to contain the inner core enclosing the bead material, wherein said second fabric comprises one or more synthetic fibers engineered to be stretchy and durable, which may be optionally treated to functionalize;

(c) the bead material comprises a plurality of rounded particulates of polymeric foam capable of free flowing movement in the absence of constant pressure applied to the pillow, and wherein the inner core is disposed inside of the outer shell, such that the combination of the inner core with the outer shell creates a dynamic response to applied pressure to the pillow for increased functional support of said pillow.

In yet another aspect, the present invention provides a multi-core (MC) functionally supportive pillow comprising a dynamically responsive combination of two or more inner cores enclosing a bead material and an outer shell, wherein (a) the inner cores are each defined by a first fabric material shaped into a pre-defined form capable of enclosing the bead material, wherein said first fabric consisting of one or more synthetic fibers engineered to be stretchy and durable, which may be optionally treated to functionalize;

(b) the outer shell is defined by a second fabric shaped to contain all inner cores enclosing the bead material, wherein said second fabric comprises one or more fibers engineered to be stretchy and durable;

(c) the bead material comprises a plurality of rounded particulates of polymeric foam capable of free flowing movement in the absence of constant pressure applied to the pillow, and wherein the inner cores are disposed inside of the outer shell, such that the combination of the inner cores with the outer shell creates a dynamic response to applied pressure to the pillow for increased functional support of said pillow.

Another aspect of the present invention provides a method of preparation of a functionally supportive pillow of present invention comprising the steps of selecting a dynamically responsive combination of an inner core enclosing a bead material and an outer shell, wherein (a) the inner core is defined by a first fabric material shaped into a pre-defined form capable of enclosing the bead material, wherein said first fabric consisting of one or more synthetic fibers engineered to be stretchy and durable, which may be optionally treated to functionalize;

(b) the outer shell is defined by a second fabric shaped to contain the inner core enclosing the bead material, wherein said second fabric comprises one or more fibers engineered to be stretchy and durable;

(c) the bead material comprises a plurality of rounded particulates of polymeric foam capable of free flowing movement in the absence of constant pressure applied to the pillow;

obtaining the inner core, the bead material, and the outer shell;

enclosing the bead material inside the inner core; and disposing the inner core inside of the outer shell, such that a functionally supportive pillow is prepared wherein the combination of the inner core with the outer shell creates a dynamic response to applied pressure to the pillow for increased functional support of said pillow.

In another aspect, the present invention provides a method of preparation of a functionally supportive pillow of the present invention comprising the steps of selecting a dynamically responsive combination of an inner core enclosing a bead material and an outer shell, wherein (a) the inner core is defined by a first fabric material shaped into a pre-defined form capable of enclosing the bead material, wherein said first fabric consisting of one or more synthetic fibers engineered to be stretchy and durable, which may be optionally treated to functionalize;

(b) the outer shell is defined by a laminated second fabric shaped to contain the inner core enclosing the bead material, wherein said second fabric comprises one or more synthetic fibers engineered to be stretchy and durable, which may be optionally treated to functionalize;

(c) the bead material comprises a plurality of rounded particulates of polymeric foam capable of free flowing movement in the absence of constant pressure applied to the pillow;

obtaining the inner core, the bead material, and the outer shell;

enclosing the bead material inside the inner core; and disposing the inner core inside of the outer shell, such that a functionally supportive pillow is prepared wherein the combination of the inner core with the outer shell creates a dynamic response to applied pressure to the pillow for increased functional support of said pillow.

In another aspect, the present invention provides a method of preparation of a functionally supportive pillow of the present invention comprising the steps of selecting a dynamically responsive combination of two or more inner cores enclosing a bead material and an outer shell, wherein (a) the inner cores are defined by a first fabric material shaped into a pre-defined form capable of enclosing the bead material, wherein said first fabric consisting of one or more synthetic fibers engineered to be stretchy and durable, which may be optionally treated to functionalize;

(b) the outer shell is defined by a second fabric shaped to contain the inner core enclosing the bead material, wherein said second fabric comprises one or more fibers engineered to be stretchy and durable, which may be optionally treated to functionalize;

(c) the bead material comprises a plurality of rounded particulates of polymeric foam capable of free flowing movement in the absence of constant pressure applied to the pillow;

obtaining the inner core, the bead material, and outer shell;

enclosing the bead material inside the inner core; and disposing the inner core inside of the outer shell, such that a functionally supportive pillow is prepared wherein the combination of the inner core with the outer shell creates a dynamic response to applied pressure to the pillow for increased functional support of said pillow.

DETAILED DESCRIPTION OF THE INVENTION

The present invention is directed to a functionally supportive pillow comprising a dynamically responsive combination of an inner core enclosing a bead material and an outer shell, such that the combination of the inner core with the outer shell creates a dynamic response to applied pressure to the pillow for increased functional support of said pillow.

The present invention, including pillows, and methods of preparation thereof, will be described with reference to the following definitions that, for convenience, are set forth below. Unless otherwise specified, the below terms used herein are defined as follows:

I. Definitions

As used herein, the term "a," "an," "the" and similar terms used in the context of the present invention (especially in the context of the claims) are to be construed to cover both the singular and plural unless otherwise indicated herein or clearly contradicted by the context.

The language "functionally supportive" as used herein describes the pillows of the present invention possessing a body conformance of greater than 50%.

The language "functional support" as used herein describes the level or extent of body conformation of a pillow, e.g., the pillows of the present invention have increased functional support based on their increased body conformation.

Figure 1A:
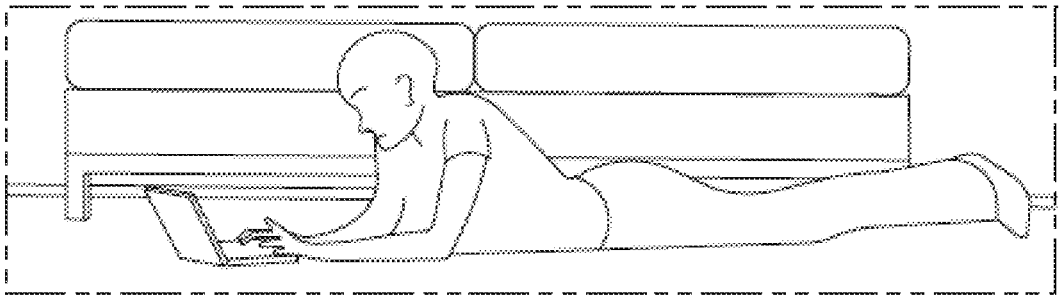
FIGS. 1 *a*), *b*), and *c*) are photographic images that depict different percentages of body conformation: 0%, 70%, and 100%, respectively.
Figure 1B:
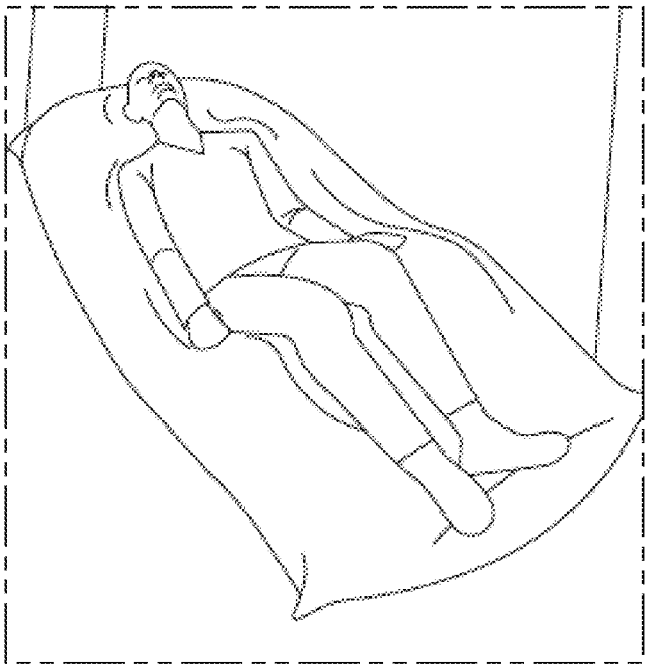
Figure 1C:
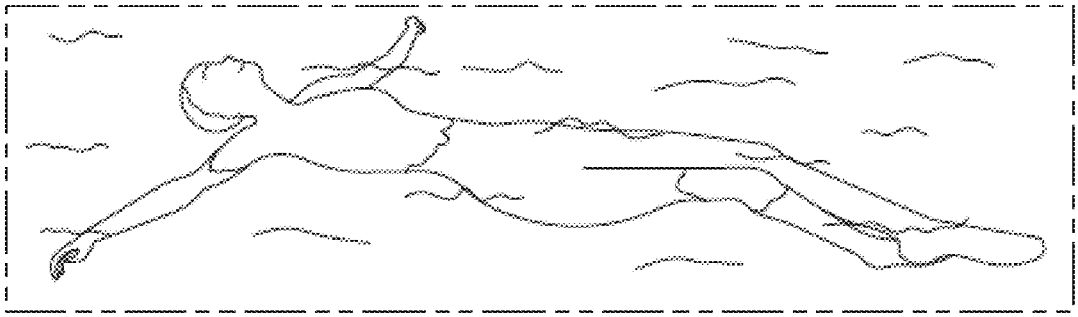

The language "body conformation" as used here describes the amount (for example, in percentages) of the body curvatures of a user that is filled by a body supporting material in various positions. The scale to measure body conformation is between Zero and 100, wherein Zero is, for example, a human body lying on a flat surface like a wooden board or the floor, and 100% is, for example, a human body submerged in water where the water is filling all the human body's curves. FIG. 1 provides additional clarity to the understanding of the degree of body conformation, and where the functionally supportive pillows of the present invention reside on the scale.

The language "dynamically responsive combination as used herein describes the compositional effect on the functional support offered by the pillows of the present invention based on the application of pressure to the pillows. A dynamic response provides a rigidifying functionally supportive configuration, for example in the pillows of the present invention, in response to the application of pressure to the pillow, e.g., from the constant pressure of a user; and alternatively a return to free flowing internal movement of the bead material in the absence of this constant pressure.

The language "stretchy" as used herein describes the elastic properties of a fabric when pulled between two points to the extent that the fabric will allow the threads constructing the fabric to be pulled without damaging the fabric and allowing the fabric to bounce or return back to original state. Moreover, maximum stretch is the state of the fabric when pulled between two points to the maximum extent. In the present invention, the fabric will allow the threads constructing the fabric to be pulled to maximum stretch without damaging the fabric and allowing the fabric to bounce back to original state like the extraction of a spring to its maximum and when released it will retract back.

The language "consisting," for example, in the expression "consisting of," is used herein to provide a composition that is limited by the contents described, and is not an open term; in contrast to the use of the term "comprising," which is used herein to represent an open inclusive group. However, the language "selected from the group consisting of" is given its standard open inclusive meaning as understood by US patent law.

The language "highly durable" as used herein describes the length of items life, wherein the item does not degrade in quality over a year period. For example, the increased durability of the pillows of the present invention result from the combination of the specific materials selected for the inner core enclosing the bead material and the outer core.

The language "treated to functionalize" as used herein describes a certain process of finishing of the fabric material by treatment to provide additional function to the fabric material through chemical treatment, such as a flame retardant, an antimicrobial agent, an anti-molding agent, an anti-static charge agent, a mosquito repellant, SCOTCH GUARD® fabric protector, a softener, and a UV resistance agent.

The language "rounded particulates" as used herein describes bead particles that are round or have an approximate round shape (i.e., without being exactly round).

The language "free flowing movement" as used herein describes a characteristic of the bead material when there is an easy freedom in movement of the bead material in the absence of applied pressure. In certain embodiments, this free flowing movement derives from the low coefficient of friction of the bead material.

The language "predefined shape" as used herein describes a three-dimensional shape pre-selected for preparation for an intended purpose, e.g., utility or design.

II. Functionally Supportive Pillows of the Invention

The present invention provides functionally supportive pillows that comprise an inner core enclosing a bead material and an outer shell, wherein the combination of these elements creates a pillow with a dynamic response to applied pressure. In particular, this innovation relates to the compilation of specific elements as described herein that create a unique body conforming and ergonomically supporting pillow design for use in various sitting, lying, reclining positions. Moreover, the pillows of the present invention achieve greater than a 50% body conformation.

The functionally supportive pillows of the present invention afford increased durability as compared with those previously known embodiments that do not possess the dynamically responsive combinations of the present invention. It is the combination of the stretchy durable materials utilized in the inner core and outer shell along with the enclosed beads that afford this increased durability along with the functionally supportive nature of the pillows of the present invention.

In certain embodiments, the functionally supportive pillows of the present invention may be utilized by the user in a chair configuration, e.g., sitting up straight.

In certain embodiments, the functionally supportive pillows of the present invention may be utilized by the user in a recliner configuration, e.g., sitting relaxed at an angle.

In certain embodiments, the functionally supportive pillows of the present invention may be utilized by the user in a bed configuration, e.g., lying down.

In certain embodiments, the functionally supportive pillows of the present invention may be utilized by the user in a mattress and/or bed configuration.

In certain embodiments, the functionally supportive pillows of the present invention may be utilized by the user in a couch configuration.

The functionally supportive pillows of the present invention are also space efficient, i.e., structural integrity of the pillows allows for storage standing them vertically and reduces space required for storing the pillow. In certain embodiments, where the pillow is positioned with the longest dimension oriented vertically, the pillow would occupy only 4 square feet of space.

In certain embodiments, a functionally supportive pillow of the present invention weighs less than 20 pounds.

In certain embodiments, a functionally supportive pillow of the present invention weighs less than 40 pounds.

The functionally supportive pillows of the present invention are also useful to support a special requirement user. Such special requirement users include, for example, pregnant women who can lay down on it on their bellies; users with a pre-identified need for back support, e.g., by a chiropractor; users identified with an orthopedic problem; users with sensory issues; and users with disabilities.

In certain embodiments, the functionally supportive pillows of the present invention may also include aromatherapy components, wherein certain aromas/scents are released upon manipulation or applied pressure to the pillow.

In certain embodiments, the functionally supportive pillows of the present invention may also comprise a heating element. In a particular embodiment, the heating element is built into the pillow, as integral part of the materials. In another particular embodiment, the heating element is a separate element.

Numerous embodiments of the present invention have been contemplated, and include, for example, the dynamically responsive combination, environmentally resistant embodiments, and multi-core embodiments.

A. Dynamically Responsive (DR) Combination

As such, one embodiment of the present invention provides a functionally supportive pillow comprising a dynamically responsive combination of an inner core enclosing a bead material and an outer shell, wherein (a) the inner core is defined by a first fabric material shaped into a pre-defined form capable of enclosing the bead material, wherein said first fabric consists of one or more synthetic fibers engineered to be stretchy and durable, which may be optionally treated to functionalize;

(b) the outer shell is defined by a second fabric shaped to contain the inner core enclosing the bead material, wherein said second fabric comprises one or more fibers engineered to be stretchy and durable;

(c) the bead material comprises a plurality of rounded particulates of polymeric foam capable of free flowing movement in the absence of constant pressure applied to the pillow, and wherein the inner core is disposed inside of the outer shell, such that the combination of the inner core with the outer shell creates a dynamic response to applied pressure to the pillow for increased functional support of said pillow.

In certain embodiments of the invention, the pillow achieves 70-80% of body conformation.

In certain embodiments of the invention, the functionally supportive pillow is highly durable upon application of repeated applied pressure.

In certain embodiments of the invention, the applied pressure is the constant weight of person.

In certain embodiments, the first fabric material is shaped into a pre-defined shape based on utility.

The first fabric material may be shaped into any form which does not substantially limit the ability of the pillow to achieve the desired function. The second fabric material is shaped to contain the inner core. In certain embodiments, the first fabric material is shaped in manner equivalent to the pillow depicted in FIG. 1 (*b*). In certain embodiments, comprising a shape similar to FIG. 1(*b*) and positioned with the longest dimension considered the length, the width of the pillow ranges from 30 cm to 200 cm. In certain embodiments, comprising a shape similar to FIG. 1(*b*) and positioned with the longest dimension considered the length, the length of the pillow ranges from 30 cm to 200 cm. In certain embodiments, comprising a shape similar to FIG. 1(*b*) and positioned with the longest dimension considered the length, the height of the pillow ranges from 15 cm to 70 cm.

In certain embodiments, the pillow shape is Round, e.g., selected from diameter range of 30 cm to 100 cm and height range from 10 cm to 30 cm. In certain embodiments, the pillow shape is Rectangular, e.g., selected from width range of 60 cm to 200 cm and length range of 90 cm to 200 cm and height range of 15 cm to 60 cm. In certain embodiments, the pillow shape is Triangle, e.g., selected from range of 30×30×30 cm to 90×90×90 cm and height range from 15 cm to 25 cm. In certain embodiments, the pillow shape is U-Shape, e.g., selected from width ranges from 30 cm to 100 cm length ranges from 30 cm to 120 cm and thickness ranges from 10 cm to 40 cm. In certain embodiments, the pillow shape is Roll Shape (or cylindrical), e.g., selected from diameter range from 20 cm to 50 cm and length ranges from 40 cm to 300 cm.

In certain embodiments, the dimensions of the pillow are selected from one of the following:

Round:
- Diameter 30 height 12 cm, or
- Diameter 45 height 15 cm;

Rectangular (W×L×H):
- 60×70×14 cm,
- 80×93×50 cm,
- 78×150×60 cm,
- 78×170×60 cm,
- 60×60×40 cm,
- 40×40×30 cm, or
- 40×40×10 cm;

U Shape (W×L×H):
- 83×93×28 cm, or
- 34×31×11 cm;

Roll (L×D):
- 220×20 cm,
- 170×30 cm,
- 80×18 cm, or
- 33×15 cm;

or

60 Degrees Triangle:
- 40×40×40 cm.

In certain embodiments, the dimensions of the pillow are not selected from one of the following:

Round:
- Diameter 30 height 12 cm, or
- Diameter 45 height 15 cm;

Rectangular (W×L×H):
- 60×70×14 cm,
- 80×93×50 cm,
- 78×150×60 cm,
- 78×170×60 cm,
- 60×60×40 cm,
- 40×40×30 cm, or
- 40×40×10 cm;

U Shape (W×L×H):
- 83×93×28 cm, or
- 34×31×11 cm;

Roll (L×D):
- 220×20 cm,
- 170×30 cm,
- 80×18 cm, or
- 33×15 cm;

or

60 Degrees Triangle:
- 40×40×40 cm.

i. Inner Core

The first fabric material that defines the inner core serves as the inner layer that contains the bead material, e.g., EPS beads, described herein.

Figure 2A:
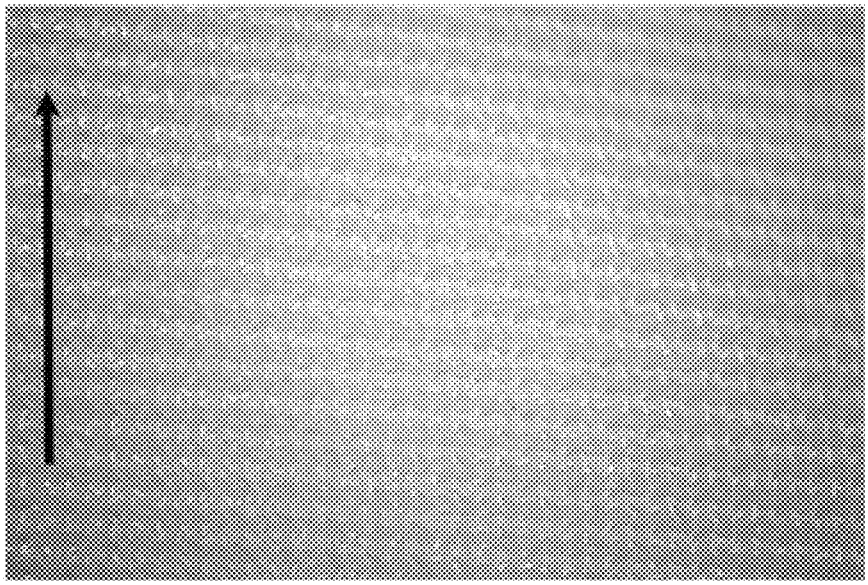
FIG. 2 provides two photographic images that depict the technical face and technical back of the tricot configuration of tricot fabric that are identified by having whales in the direction of the knitting of the fabric on the Technical Face versus whales going sideway on the Technical Back.
Figure 2B:
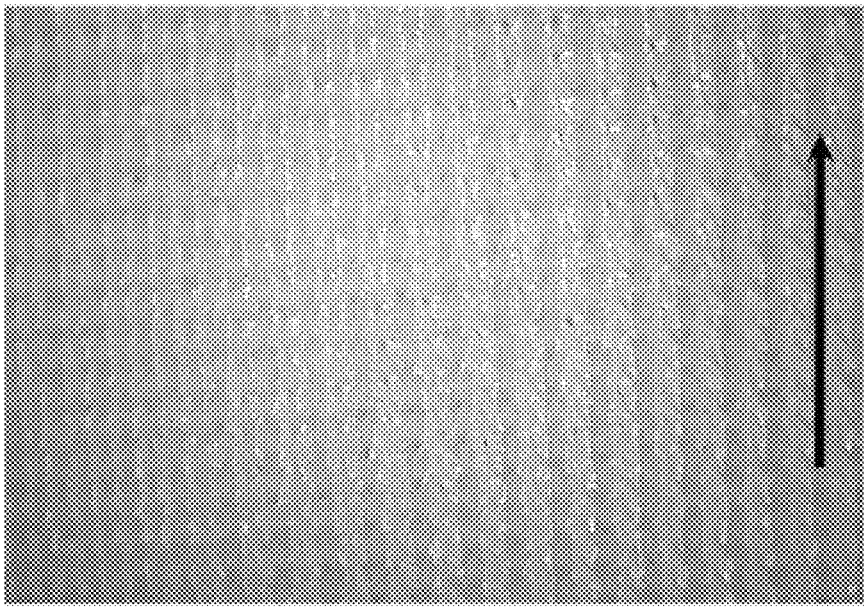
Figure 3:
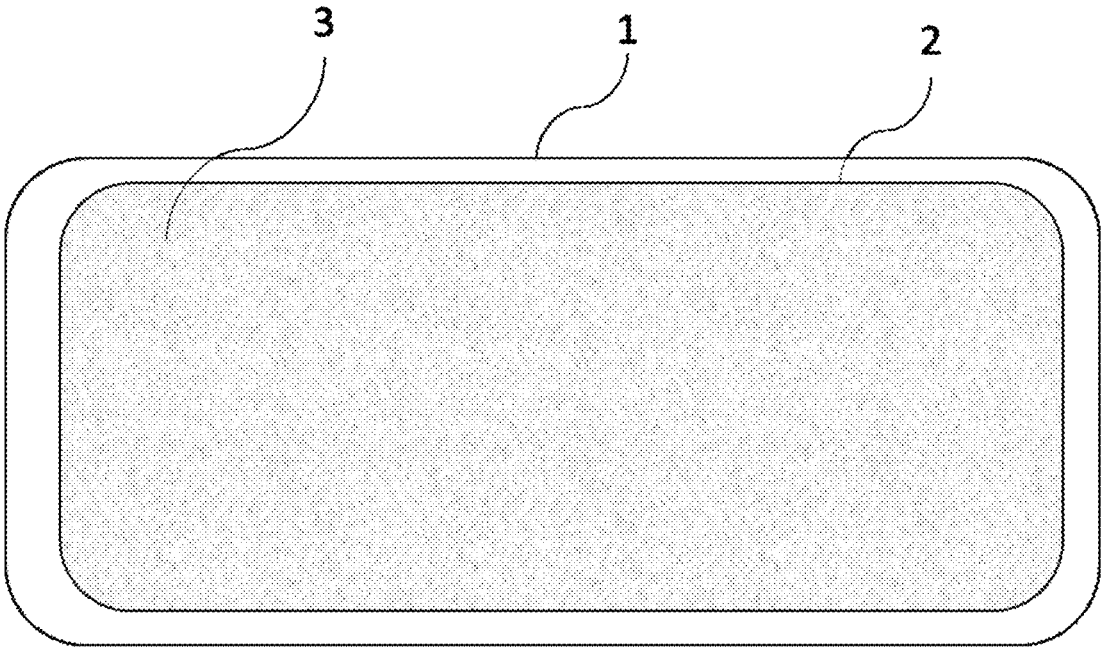
FIG. 3 depicts a cross-sectional view of a combination of an inner core 2 enclosing a bead material 3 and an outer shell 1, wherein the inner core 2 is disposed inside of the outer shell 1.

In certain embodiments of the invention, the first fabric material is non-circular knitted fabric, wherein the non-circular knitting affords increased strength and durability of the combination of inner core with the outer shell. In certain embodiments, the first fabric is Tricot fabric, e.g., in any Tricot configuration, e.g., Satin Tricot, that is identified by having whales in the direction of the knitting of the fabric on the Technical Face versus whales going sideway on the Technical Back. The difference in configuration may be seen in FIG. 2.

Yarns that comprise the first fabric material can be of any kind of knitting yarns from any synthetic material, e.g., one or more synthetic fibers, of any thickness in any combinations, mixtures and ratios. In certain embodiments, the first material comprises 150 Denier Polyester and 70 Denier (78 DTex) Spandex e.g., Lycra® by DuPont. The yarn mix and materials mix can be of any possible kind and ratios, e.g., 92% Polyester and 8% Lycra Spandex.

In certain embodiments of the invention, the first fabric material is created/knitted on either a Tricot or a Raschel knitting machine of any kind and any possible configuration, Gage, width, number of needle bars, number of guide bars, number of beams (directly driven or separately). In a particular embodiment, the first fabric material is knitted on a classic Tricot machine at 28 Gage (number needles per inch) with Satin Tricot settings.

In certain embodiments of the invention, the inner core is shaped into pre-defined form by stitching.

In certain embodiments of the invention, the inner core comprises a zipper.

In certain embodiments of the invention, the first fabric material is tricot fabric.

In certain embodiments of the invention, the first fabric material comprises a yarn mix ratio of 92% Polyester yarn and 8% Lycra Spandex yarn.

The first fabric material may be dyed by any available appropriate dyestuff, for example, disperse dyestuff, in any formulas and combinations and any possible processes and to any color on any dying or printing equipment, e.g., provided that such dye stuff does not significantly affect the quality of the first fabric material. In certain embodiments, finishing of the first fabric material by treatment to functionalize the first fabric material may comprise one or more chemical treatments, such as a flame retardant, an antimicrobial agent, an anti-molding agent, an anti-static charge agent, a mosquito repellant, SCOTCH GUARD® fabric protector, a softener, and a UV resistance agent. In certain embodiments, gentle methods are utilized. In certain embodiments, the dying process does not involve jet dying machines.

In certain embodiments of the invention, the first fabric material is treated to functionalize the material, e.g., provided that such treatment does not significantly affect the quality of the first fabric material.

In certain embodiments of the invention, the first fabric material is treated to functionalize the material with an agent selected from one or more of the group consisting of a flame retardant, an antimicrobial agent, an anti-molding agent, an anti-static charge agent, a mosquito repellant, SCOTCH GUARD® fabric protector, a softener, and a UV resistance agent. In certain embodiments, the first fabric material is treated to functionalize the material with a flame retardant, e.g., Pyrovatex SVC®. Fire Retardant treatment can be done with any industry standard materials, e.g., Pyrovatex SVC® by Huntsman and meet Technical Bulletin CA 117 Section 'e' standard.

In the preparation of the first fabric material for the inner core, the step of fabric fixation and sizing is performed, e.g., at any stage in the process of dying and finishing and should not exceed 300 degrees Fahrenheit. In certain embodiments, the step of fabric fixation and sizing is performed after scouring and before dying.

Fabric fixation and sizing may be under any possible conditions of stretch and tension, timing, duration, and width settings; however, heat level but should not exceed 300 degrees Fahrenheit.

Width sizing settings will depend on the original machine size. In certain embodiments, fabric width of the first fabric material on the machine take-up is 155 cm-160 cm, and sizing is set to 160 cm-165 cm final width.

In certain embodiments of the invention, the final first fabric material weight is between 200 GSM and 210 GSM (Gram per Square Meter) measured on relaxed fabric per industry standard.

In certain embodiments of the invention, the final maximum stretch of the fabric may reach at least 120% in the knitting direction and 80% the sideway direction.

The first fabric material may be prepared by one or more of the following steps, knitting, scouring, fixation, sizing, dying, and finishing.

In certain embodiments of the invention, the first fabric material is not the same as the second fabric material.

ii. Outer Shell

The second fabric material that defines the outer shell serves as the outer layer of the functionally supportive pillow of the present invention.

In certain embodiments of the invention, the second fabric material is circular knitted fabric.

Yarns that comprise the second fabric material can be of any kind of knitting yarns from any material of any thickness in any combinations, mixtures and ratios. In certain embodiments, the first material comprises 30 Nec (English count) fine grade combed cotton and 70 Denier (78 DTex) Spandex, e.g., Lycra® by DuPont. The yarn mix and materials mix can be of any possible kind and ratios, e.g., 88.5% Cotton and 11.5% Lycra® Spandex (about 89% cotton/11% spandex).

In certain embodiments of the invention, the second fabric material is created/knitted on any diameter circular knitting machine of any sort (i.e. single jersey, rib, tricot etc) and any patterning setups, cam combination, number of needle tracks, number of feeders, yarn tension controls, as well as Jacquard patterning of any kind at any Gage (needle density). In a particular embodiment, the second fabric material is knitted on 30" diameter machine at 28 Gage single jersey, 2640 or 2660 needles with dedicated adjustable spandex feeders.

In an alternative embodiment of the invention, the second fabric material is produced on a 24 Gage machine, e.g., using 24 Nec Cotton Yarn count and 70 Denier Lycra at 91.5%/8.5% ratio, respectively.

The yarn consumption can be set to any possible setting that the mentioned machines will allow. In certain embodiments, the cotton eye length is 2.7 mm and the spandex eye length is 0.88 mm. Consumption may be calculated based on number of needles in the machine as mentioned above and as multiplication of the number of needles by the eye length, and measured as meters per turn.

In certain embodiments of the invention, the first fabric material comprises a yarn mix ratio of 88.5% Cotton yarn and 11.5% Spandex yarn.

In certain embodiments of the invention, the second material consists of one or more synthetic fibers. In particular embodiments of the invention the second fabric material is same as first fabric material.

In certain embodiments of the invention, the outer shell is shaped into pre-defined form by stitching.

In certain embodiments of the invention, the outer shell comprises a zipper.

In certain embodiments of the invention, the outer shell is machine washable

In certain embodiments of the invention, the outer shell comes in 14 colors.

The second fabric material may be dyed by any available appropriate dyestuff, for example, disperse dye stuff for synthetic fibers or reactive dyestuff for cotton containing fibers, in any formulas and combinations and any possible processes and to any color on any dying or printing equipment, e.g., provided that such dye stuff does not significantly affect the quality of the second fabric material. In certain embodiments, finishing of the cotton containing second fabric material by treatment to functionalize the second fabric material may comprise one or more chemical treatments, such as an antimicrobial agent, an anti-molding agent, an anti-static charge agent, a mosquito repellant, SCOTCH GUARD® fabric protector, a softener, and a UV resistance agent. In certain embodiments, finishing of the synthetic fiber second fabric material by treatment to functionalize the second fabric material may comprise one or more chemical treatments, such as a flame retardant, an antimicrobial agent, an anti-molding agent, an anti-static charge agent, a mosquito repellant, SCOTCH GUARD® fabric protector, a softener, and a UV resistance agent. In certain embodiments, gentle methods are utilized. In certain embodiments, the dying process does not involve jet dying machines.

In the preparation of the second fabric material for the inner core, the step of fabric fixation and sizing is performed, e.g., at any stage in the process of dying and finishing and should not exceed 300 degrees Fahrenheit. In certain embodiments, the step of fabric fixation and sizing is performed after scouring and before dying.

Fabric fixation and sizing may be under any possible conditions of stretch and tension, timing, duration, and width settings; however, heat level but should not exceed 300 degrees Fahrenheit.

Width sizing settings will depend on the original machine size. In certain embodiments, fabric width of the second fabric material is sized to the width of 160 cm for 45 seconds at 190 degrees Celsius. In particular embodiments, the second fabric material is finished with hydrophobic silicon for water and oil repellency.

In certain embodiments of the invention, the second fabric material weight prior to dying or finishing (cut and weighed directly from the knotting machine) will be about 260 GSM (Gram per Square Meter).

In certain embodiments of the invention, the final second fabric material weight is between 280 GSM and 300 GSM (Gram per Square Meter) measured on relaxed fabric per industry standard.

In certain embodiments of the invention, the final maximum stretch of the fabric may reach at least 100%, i.e., double the size of the original unstretched material.

iii. Bead Material

The bead material is contained within the inner core and comprises rounded particulates of polymeric foam capable of free flowing movement in the absence of constant pressure applied to the pillow.

In certain embodiments of the invention, the bead material fills greater than 80% of the maximum volume of the inner core.

In certain embodiments of the invention, the bead material fills greater than 90% of the maximum volume of the inner core.

In certain embodiments of the invention, the bead material particulates range from 0.5 mm to 5 mm in diameter, e.g., and may be a mix of sizes.

In certain embodiments of the invention, the bead material particulates are expanded polystyrene (EPS) STYROFOAM® EPS beads, e.g., industry standard EPS beads. The size of the beads can be at any size, e.g., 0.5 mm to 5 mm, and may be a mix of sizes. Known industry sizes are Type B and Type C beads, each of which may be used herein.

B. Environmentally Resistant (ER) Embodiments

In another embodiment, the present invention provides an environmentally resistant (ER) functionally supportive pillow. These pillows are resistant to degradation, destruction, damage, or compromise by one or more environmental conditions or elements that would otherwise degrade, destroy, damage or compromise an unmodified dynamically responsive (DR) combination under such conditions. In certain embodiments, these pillows are resistant (i.e., completely or partially) to degradation, destruction, damage, or compromise from environmental conditions or elements selected from the group consisting of moisture, UV, pet damage, temperature, or any combination thereof. The environmentally resistant (ER) functionally supportive pillow of the present inventions comprises a dynamically responsive combination of an inner core enclosing a bead material and an outer shell, wherein (a) the inner core is defined by a first fabric material shaped into a pre-defined form capable of enclosing the bead material, wherein said first fabric consisting of one or more synthetic fibers engineered to be stretchy and durable, which may be optionally treated to functionalize;

(b) the outer shell is defined by a laminated second fabric shaped to contain the inner core enclosing the bead material, wherein said second fabric comprises one or more synthetic fibers engineered to be stretchy and durable, which may be optionally treated to functionalize;

(c) the bead material comprises a plurality of rounded particulates of polymeric foam capable of free flowing movement in the absence of constant pressure applied to the pillow, and wherein the inner core is disposed inside of the outer shell, such that the combination of the inner core with the outer shell creates a dynamic response to applied pressure to the pillow for increased functional support of said pillow.

In an alternative embodiment, the environmentally resistant (ER) functionally supportive pillow of the present inventions comprises a dynamically responsive combination of an inner core enclosing a bead material and an outer shell, wherein (a) the inner core is defined by a laminated first fabric material shaped into a pre-defined form capable of enclosing the bead material, wherein said first fabric consisting of one or more synthetic fibers engineered to be stretchy and durable, which may be optionally treated to functionalize;

(b) the outer shell is defined by a second fabric shaped to contain the inner core enclosing the bead material, wherein said second fabric comprises one or more fibers engineered to be stretchy and durable, which may be optionally treated to functionalize;

(c) the bead material comprises a plurality of rounded particulates of polymeric foam capable of free flowing movement in the absence of constant pressure applied to the pillow, and wherein the inner core is disposed inside of the outer shell, such that the combination of the inner core with the outer shell creates a dynamic response to applied pressure to the pillow for increased functional support of said pillow. In certain embodiments, the second fabric material is one or more synthetic fibers, e.g., one or more laminated synthetic fibers.

In certain embodiments of the invention, the pillow achieves 60-70% of body conformation.

In certain embodiments of the invention, the functionally supportive pillow is highly durable upon application of repeated applied pressure.

In certain embodiments of the invention, the applied pressure is the constant weight of person.

The first fabric material may be shaped into any form which does not substantially limit the ability of the pillow to achieve the desired function. The second fabric material is shaped to contain the inner core. In certain embodiments, the first fabric material is shaped in manner equivalent to the pillow depicted in FIG. 1 (*b*). In certain embodiments, comprising a shape similar to FIG. 1(*b*) and positioned with the longest dimension considered the length, the width of the pillow ranges from 30 cm to 200 cm. In certain embodiments, comprising a shape similar to FIG. 1(*b*) and positioned with the longest dimension considered the length, the length of the pillow ranges from 30 cm to 200 cm. In certain embodiments, comprising a shape similar to FIG. 1(*b*) and positioned with the longest dimension considered the length, the height of the pillow ranges from 15 cm to 70 cm.

In certain embodiments, the pillow shape is Round, e.g., selected from diameter range of 30 cm to 100 cm and height range from 10 cm to 30 cm. In certain embodiments, the pillow shape is Rectangular, e.g., selected from width range of 60 cm to 200 cm and length range of 90 cm to 200 cm and height range of 15 cm to 60 cm. In certain embodiments, the pillow shape is Triangle, e.g., selected from range of 30×30×30 cm to 90×90×90 cm and height range from 15 cm to 25 cm. In certain embodiments, the pillow shape is U-Shape, e.g., selected from width ranges from 30 cm to 100 cm length ranges from 30 cm to 120 cm and thickness ranges from 10 cm to 40 cm. In certain embodiments, the pillow shape is Roll Shape, e.g., selected from diameter range from 20 cm to 50 cm and length ranges from 40 cm to 300 cm.

In certain embodiments, the dimensions of the pillow are selected from one of the following:

Round:
- Diameter 30 height 12 cm, or
- Diameter 45 height 15 cm;

Rectangular (W×L×H):
- 60×70×14 cm,
- 80×93×50 cm,
- 78×150×60 cm,
- 78×170×60 cm,
- 60×60×40 cm,
- 40×40×30 cm, or
- 40×40×10 cm;

U Shape (W×L×H):
- 83×93×28 cm, or
- 34×31×11 cm;

Roll (L×D):
- 220×20 cm,
- 170×30 cm,
- 80×18 cm, or
- 33×15 cm;

or

60 Degrees Triangle:
- 40×40×40 cm.

In certain embodiments, the dimensions of the pillow are not selected from one of the following:

Round:
- Diameter 30 height 12 cm, or
- Diameter 45 height 15 cm;

Rectangular (W×L×H):
- 60×70×14 cm,
- 80×93×50 cm,
- 78×150×60 cm,
- 78×170×60 cm,
- 60×60×40 cm,
- 40×40×30 cm, or
- 40×40×10 cm;

U Shape (W×L×H):
- 83×93×28 cm, or
- 34×31×11 cm;

Roll (L×D):
- 220×20 cm,
- 170×30 cm,
- 80×18 cm, or
- 33×15 cm;

or

60 Degrees Triangle:
- 40×40×40 cm.

i. Inner Core

The first fabric material that defines the inner core serves as the inner layer that contains the bead material, e.g., EPS beads, described herein.

In certain embodiments of the invention, the first fabric material is non-circular knitted fabric, wherein the non-circular knitting affords increased strength and durability of the combination of inner core with the outer shell. In certain embodiments, the first fabric is Tricot fabric, e.g., in any Tricot configuration, e.g., Satin Tricot that is identified by having whales in the direction of the knitting of the fabric on the Technical Face versus whales going sideway on the Technical Back. The difference in configuration may be seen in FIG. 2.

Yarns that comprise the first fabric material can be of any kind of knitting yarns from any synthetic material, e.g., one or more synthetic fibers, of any thickness in any combinations, mixtures and ratios. In certain embodiments, the first material comprises 150 Denier Polyester and 70 Denier (78 DTex) Spandex e.g., Lycra® by DuPont. The yarn mix and materials mix can be of any possible kind and ratios, e.g., 92% Polyester and 8% Lycra Spandex.

In certain embodiments of the invention, the first fabric material is created/knitted on either a Tricot or a Raschel knitting machine of any kind and any possible configuration, Gage, width, number of needle bars, number of guide bars, number of beams (directly driven or separately). In a particular embodiment, the first fabric material is knitted on a classic Tricot machine at 28 Gage (number needles per inch) with Satin Tricot settings.

In certain embodiments of the invention, the inner core is shaped into pre-defined form by stitching.

In certain embodiments of the invention, the inner core comprises a zipper.

In certain embodiments of the invention, the first fabric material is tricot fabric.

In certain embodiments of the invention, the first fabric material comprises a yarn mix ratio of 92% Polyester yarn and 8% Lycra Spandex yarn.

The first fabric material may be dyed by any available appropriate dyestuff, for example, disperse dye stuff, in any formulas and combinations and any possible processes and to any color on any dying or printing equipment, e.g., provided that such dye stuff does not significantly affect the quality of the first fabric material. In certain embodiments, finishing of the first fabric material by treatment to functionalize the first fabric material may comprise one or more chemical treatments, such as a flame retardant, an antimicrobial agent, an anti-molding agent, an anti-static charge agent, a mosquito repellant, SCOTCH GUARD® fabric protector, a softener, and a UV resistance agent. In certain embodiments, gentle methods are utilized. In certain embodiments, the dying process does not involve jet dying machines.

In certain embodiments of the invention, the first fabric material is treated to functionalize the material, e.g., provided that such treatment does not significantly affect the quality of the first fabric material.

In certain embodiments of the invention, the first fabric material is treated to functionalize the material with an agent selected from one or more of the group consisting of a flame retardant, an antimicrobial agent, an anti-molding agent, an anti-static charge agent, a mosquito repellant, SCOTCH GUARD® fabric protector, a softener, and a UV resistance agent. In certain embodiments, the first fabric material is treated to functionalize the material with a flame retardant, e.g., Pyrovatex SVC®. Fire Retardant treatment can be done with any industry standard materials, e.g., Pyrovatex SVC® by Huntsman and meet Technical Bulletin CA 117 Section 'e' standard.

In the preparation of the first fabric material for the inner core, the step of fabric fixation and sizing is performed, e.g., at any stage in the process of dying and finishing and should not exceed 300 degrees Fahrenheit. In certain embodiments, the step of fabric fixation and sizing is performed after scouring and before dying.

Fabric fixation and sizing may be under any possible conditions of stretch and tension, timing, duration, and width settings; however, heat level should not exceed 300 degrees Fahrenheit.

Width sizing settings will depend on the original machine size. In certain embodiments, fabric width of the first fabric material on the machine take-up is 155 cm-160 cm, and sizing is set to 160 cm-165 cm final width.

In certain embodiments of the invention, the final first fabric material weight is between 200 GSM and 210 GSM (Gram per Square Meter) measured on relaxed fabric per industry standard.

In certain embodiments of the invention, the final maximum stretch of the fabric may reach at least 120% in the knitting direction and 80% in the sideway direction.

In certain embodiments of the invention, the first fabric material is not the same as the second fabric material.

ii. Outer Shell

The second fabric material that defines the outer shell serves as the outer layer of the functionally supportive pillow of the present invention.

In certain embodiments of the invention, the second fabric material is same as the first fabric material.

a) Laminated Inner core/Non-Laminated Outer Shell

In certain embodiments of the invention wherein the first material is laminated, the second fabric material may be circular knitted fabric.

Yarns that comprise the second fabric material can be of any kind of knitting yarns from any material of any thickness in any combinations, mixtures and ratios. In certain embodiments, the first material comprises 30 Nec (English count) fine grade combed cotton and 70 Denier (78 DTex) Spandex, e.g., Lycra® by DuPont. The yarn mix and materials mix can be of any possible kind and ratios, e.g., 88.5% Cotton and 11.5% Lycra® Spandex (about 89% cotton 11% spandex).

In certain embodiments of the invention, the second fabric material is created/knitted on any diameter circular knitting machine of any sort (i.e. single jersey, rib, tricot etc) and any patterning setups, cam combination, number of needle tracks, number of feeders, yarn tension controls, as well as Jacquard patterning of any kind at any Gage (needle density). In a particular embodiment, the second fabric material is knitted on 30" diameter machine at 28 Gage single jersey, 2640 or 2660 needles with dedicated adjustable spandex feeders.

In an alternative embodiment of the invention, the second fabric material is produced on a 24 Gage machine, e.g., using 24 Nec Cotton Yarn count and 70 Denier Lycra at 91.5%/8.5% ratio, respectively.

The yarn consumption can be set to any possible setting that the mentioned machines will allow. In certain embodiments, the cotton eye length is 2.7 mm and the spandex eye length is 0.88 mm. Consumption may be calculated based on number of needles in the machine as mentioned above and as multiplication of the number of needles by the eye length, and measured as meters per turn.

In certain embodiments of the invention, the first fabric material comprises a yarn mix ratio of 88.5% Cotton yarn and 11.5% Spandex yarn.

b) Laminated Outer Shell

In certain embodiments of the invention, the second material consists of one or more synthetic fibers. In particular embodiments of the invention, the second fabric material is same as first fabric material.

In certain embodiments of the invention, the second fabric material is non-circular knitted fabric. In certain embodiments, the second fabric material is Tricot fabric, e.g., in any Tricot configuration, e.g., Satin Tricot that is identified by having whales in the direction of the knitting of the fabric on the Technical Face versus whales going sideway on the Technical Back. The difference in configuration may be seen in FIG. 2.

Yarns that comprise the second fabric material can be of any kind of knitting yarns from any synthetic material, e.g., one or more synthetic fibers, of any thickness in any combinations, mixtures and ratios. In certain embodiments, the second fabric material comprises 150 Denier Polyester and 70 Denier (78 DTex) Spandex e.g., Lycra® by DuPont. The yarn mix and materials mix can be of any possible kind and ratios, e.g., 92% Polyester and 8% Lycra Spandex.

In certain embodiments of the invention, the second fabric material is created/knitted on either a Tricot or a Raschel knitting machine of any kind and any possible configuration, Gage, width, number of needle bars, number of guide bars, number of beams (directly driven or separately). In a particular embodiment, the second fabric material is knitted on a classic Tricot machine at 28 Gage (number needles per inch) with Satin Tricot settings.

In certain embodiments of the invention, the outer shell is shaped into pre-defined form by stitching.

In certain embodiments of the invention, the outer shell comprises a zipper.

In certain embodiments of the invention, the outer shell is machine washable c) General Lamination Process In certain embodiments, the synthetic first or second fabric material may be laminated with any suitable lamination materials, e.g., PU (Polyurethane) or TPU (Thermoplastic Polyurethane) film and/or liquid of any formula similar to Argotec TX1540 products with similar properties (see Table 1 below).

TABLE 1

TPU Film properties

| Physical Property | ASTM Test Method | Units | Test Value |
|---|---|---|---|
| Specific gravity | D-792 | g/cc | 1.22 |
| Shore hardness | D-2240 | Shore | 80A |
| Tensile strength | D-412 | psi | 4000-5000 |
| | | MPa | 27.6-34.5 |
| Elongation | | % | 600-700 |
| Modulus (100%) | | psi | 550-650 |
| | | MPa | 3.8-4.5 |
| Tensile set @ 200% elongation | | % | >40 |
| Tear (die C) | D-1004 | Graves g/0.001" | 120-140 |
| Moisture vapor transmission | E-96 procedure B | | |
| 0.5 mil (12μ) | upright* | $g/m^2/24$ hr | — |
| 0.6 mil (15μ) | | | 800-900 |
| 1.0 mil (25μ) | | | 700-800 |

The lamination may be applied by heat and/or by adhesives of any kind, e.g., bonded by heat, or water-based or solvent-based adhesives, e.g., polyurethane adhesives consisting of a high molecular weight hydroxyl terminated polyurethane dissolved in a solvent, with or without isocyantes such as toluene diisocyanate (TDI) and diphenylmethane isocyanate (MDI) to avoid discoloration and deterioration of mechanical properties of the adhesive and/or combine antioxidant and UV absorbers for stabilization.

The laminated film may be any thickness, e.g., 1-1.5 mils.

In certain embodiments of the invention, the second fabric material is laminated with a Polyurethane or Thermoplastic Polyurethane film.

In certain embodiments of the invention, the thickness of laminated film is 1-1.5 mils.

In certain embodiments of the invention, the laminated material is treated to functionalize the material. In certain embodiments, the laminated material is treated to functionalize the material with an agent selected from one or more of the group consisting of a flame retardant, an antimicrobial agent, an anti-molding agent, an anti-static charge agent, a mosquito repellant, SCOTCH GUARD® fabric protector, a softener, and a UV resistance agent. In particular embodiments, the laminated material is treated to functionalize the material with a flame retardant, e.g., Pyrovatex SVC®.

The second fabric material may be dyed by any available appropriate dyestuff, for example, disperse dyestuff for synthetic fibers or reactive dyestuff for cotton containing fibers, in any formulas and combinations and any possible processes and to any color on any dying or printing equipment, e.g., provided that such dyestuff does not significantly affect the quality of the second fabric material.

In certain embodiments of the invention, the outer shell may be selected from a range of colors, e.g., cream, pink, red, burgundy, orange, yellow caramel, Celtic green, green, turquoise, blue, bright purple, purple, black, dark gray, light gray, or brown.

In the preparation of the second fabric material for the inner core, the step of fabric fixation and sizing is performed, e.g., at any stage in the process of dying and finishing and should not exceed 300 degrees Fahrenheit. In certain embodiments, the step of fabric fixation and sizing is performed after scouring and before dying.

Fabric fixation and sizing may be under any possible conditions of stretch and tension, timing, duration, and width settings; however, heat level should not exceed 300 degrees Fahrenheit.

Width sizing settings will depend on the original machine size. In certain embodiments, fabric width of the second fabric material is sized to the width of 160 cm for 45 seconds at 190 degrees Celsius. In particular embodiments, the second fabric material is finished with hydrophobic silicon for water and oil repellency.

In certain embodiments of the invention, the second fabric material weight prior to dying or finishing (cut and weighed directly from the knotting machine) will be about 260 GSM (Gram per Square Meter).

In certain embodiments of the invention, the final second fabric material weight is between 280 GSM and 300 GSM (Gram per Square Meter) measured on relaxed fabric per industry standard.

In certain embodiments of the invention, the final maximum stretch of the fabric may reach at least 100%.

The present invention also is intended to include any novel laminated second material created herein, and the respective uses for purposes other than the pillows described herein. Such additional uses for this material include, but are not limited to mattress covers, outdoor covers, boating upholstery, outdoor furniture upholstery, and personal accessory items such as bags, e.g., handbags.

iii. Bead Material

The bead material is contained within the inner core and comprises rounded particulates of polymeric foam capable of free flowing movement in the absence of constant pressure applied to the pillow.

In certain embodiments of the invention, the bead material fills greater than 80% of the maximum volume of the inner core.

In certain embodiments of the invention, the bead material fills greater than 90% of the maximum volume of the inner core.

In certain embodiments of the invention, the bead material particulates range from 0.5 mm to 5 mm in diameter, e.g., and may be a mix of sizes.

In certain embodiments of the invention, the bead material particulates are expanded polystyrene (EPS) STYROFOAM® EPS beads, e.g., industry standard EPS beads. The size of the beads can be at any size, e.g., 0.5 mm to 5 mm, and may be a mix of sizes. Known industry sizes are Type B and Type C beads, each of which may be used herein.

C. Multi-Core (MC) Embodiments

In another embodiment, the present invention provides a multi-core (MC) functionally supportive pillow comprising a dynamically responsive combination of two or more inner cores enclosing a bead material and an outer shell, wherein (a) the inner cores are each defined by a first fabric material shaped into a pre-defined form capable of enclosing the bead material, wherein said first fabric consisting of one or more synthetic fibers engineered to be stretchy and durable, which may be optionally treated to functionalize;

(b) the outer shell is defined by a second fabric shaped to contain all inner cores enclosing the bead material, wherein said second fabric comprises one or more fibers engineered to be stretchy and durable;

(c) the bead material comprises a plurality of rounded particulates of polymeric foam capable of free flowing movement in the absence of constant pressure applied to the pillow, and wherein the inner cores are disposed inside of the outer shell, such that the combination of the inner cores with the outer shell creates a dynamic response to applied pressure to the pillow for increased functional support of said pillow.

In certain embodiments of the invention, the pillow achieves 70-80% of body conformation.

Contrary to expectation, the combination of multiple inner cores surprisingly provides an equivalent functional support to single larger pillow, rather than the feeling of the separate independent inner cores. As such, in certain embodiments, the pillow achieves 70-80% of body conformation. Moreover, the larger functionally supportive pillows of the present invention may be constructed of multiple smaller (and more easily handled, and/or commercially delivered) inner cores. Alternatively, a multi-core functionally supportive pillow of the invention may be deconstructed to afford inner core components of a single inner core functionally supportive pillow of the invention.

In certain embodiments of the invention, the functionally supportive pillow is highly durable upon application of repeated applied pressure.

In certain embodiments of the invention, the applied pressure is the constant weight of person.

The first fabric material may be shaped into any form which does not substantially limit the ability of the pillow to achieve the desired function. The second fabric material is shaped to contain the inner core. In certain embodiments, the first fabric material is shaped in manner equivalent to the pillow depicted in FIG. 1 (*b*). In certain embodiments, comprising a shape similar to FIG. 1(*b*) and positioned with the longest dimension considered the length, the width of the pillow ranges from 30 cm to 200 cm. In certain embodiments, comprising a shape similar to FIG. 1(*b*) and positioned with the longest dimension considered the length, the length of the pillow ranges from 30 cm to 200 cm. In certain embodiments, comprising a shape similar to FIG. 1(*b*) and positioned with the longest dimension considered the length, the height of the pillow ranges from 15 cm to 70 cm.

In certain embodiments, the pillow shape is Round, e.g., selected from diameter range of 30 cm to 100 cm and height range from 10 cm to 30 cm. In certain embodiments, the pillow shape is Rectangular, e.g., selected from width range of 60 cm to 200 cm and length range of 90 cm to 200 cm and height range of 15 cm to 60 cm. In certain embodiments, the pillow shape is Triangle, e.g., selected from range of 30×30×30 cm to 90×90×90 cm and height range from 15 cm to 25 cm. In certain embodiments, the pillow shape is U-Shape, e.g., selected from width ranges from 30 cm to 100 cm length ranges from 30 cm to 120 cm and thickness ranges from 10 cm to 40 cm. In certain embodiments, the pillow shape is Roll Shape, e.g., selected from diameter range from 20 cm to 50 cm and length ranges from 40 cm to 300 cm.

In certain embodiments, the dimensions of the pillow are selected from one of the following:

Round:
- Diameter 30 height 12 cm, or
- Diameter 45 height 15 cm;

Rectangular (W×L×H):
- 60×70×14 cm,
- 80×93×50 cm,
- 78×150×60 cm,
- 78×170×60 cm,
- 60×60×40 cm,
- 40×40×30 cm,
- 40×40×10 cm, or
- 140×175×50 cm;

U Shape (W×L×H):
- 83×93×28 cm, or
- 34×31×11 cm;

Roll (L×D):
- 220×20 cm,
- 170×30 cm,
- 80×18 cm, or
- 33×15 cm;

or

60 Degrees Triangle:
- 40×40×40 cm.

In certain embodiments, the pillow is not rectangular with dimensions 140×175×50 cm.

i. Inner Core

The first fabric material that defines the inner cores served as the inner layers that contains the bead material, e.g., EPS beads, described herein.

In certain embodiments of the invention, the first fabric material is non-circular knitted fabric, wherein the non-circular knitting affords increased strength and durability of the combination of inner core with the outer shell. In certain embodiments, the first fabric is Tricot fabric, e.g., in any Tricot configuration, e.g., Satin Tricot that is identified by having whales in the direction of the knitting of the fabric on the Technical Face versus whales going sideway on the Technical Back. The difference in configuration may be seen in FIG. 2.

Yarns that comprise the first fabric material can be of any kind of knitting yarns from any synthetic material, e.g., one or more synthetic fibers, of any thickness in any combinations, mixtures and ratios. In certain embodiments, the first material comprises 150 Denier Polyester and 70 Denier (78 DTex) Spandex e.g., Lycra® by DuPont. The yarn mix and materials mix can be of any possible kind and ratios, e.g., 92% Polyester and 8% Lycra Spandex.

In certain embodiments of the invention, the first fabric material is created/knitted on either a Tricot or a Raschel knitting machine of any kind and any possible configuration, Gage, width, number of needle bars, number of guide bars, number of beams (directly driven or separately). In a particular embodiment, the first fabric material is knitted on a classic Tricot machine at 28 Gage (number needles per inch) with Satin Tricot settings.

In certain embodiments of the invention, the inner cores are shaped into pre-defined form by stitching.

In certain embodiments of the invention, the inner cores comprise a zipper.

In certain embodiments of the invention, the first fabric material is tricot fabric.

In certain embodiments of the invention, the first fabric material comprises a yarn mix ratio of 92% Polyester yarn and 8% Lycra Spandex yarn.

The first fabric material may be dyed by any available appropriate dyestuff, for example, disperse dyestuff, in any formulas and combinations and any possible processes and to any color on any dying or printing equipment, e.g., provided that such dyestuff does not significantly affect the quality of the first fabric material. In certain embodiments, finishing of the first fabric material by treatment to functionalize the first fabric material may comprise one or more chemical treatments, such as a flame retardant, an antimicrobial agent, an anti-molding agent, an anti-static charge agent, a mosquito repellant, SCOTCH GUARD® fabric protector, a softener, and a UV resistance agent. In certain embodiments, gentle methods are utilized. In certain embodiments, the dying process does not involve jet dying machines.

In certain embodiments of the invention, the first fabric material is treated to functionalize the material, e.g., provided that such treatment does not significantly affect the quality of the first fabric material.

In certain embodiments of the invention, the first fabric material is treated to functionalize the material with an agent selected from one or more of the group consisting of a flame retardant, an antimicrobial agent, an anti-molding agent, an anti-static charge agent, a mosquito repellant, SCOTCH GUARD® fabric protector, a softener, and a UV resistance agent. In certain embodiments, the first fabric material is treated to functionalize the material with a flame retardant, e.g., Pyrovatex SVC®. Fire Retardant treatment can be done with any industry standard materials, e.g., Pyrovatex SVC® by Huntsman and meet Technical Bulletin CA 117 Section 'e' standard.

In the preparation of the first fabric material for the inner cores, the step of fabric fixation and sizing is performed, e.g., at any stage in the process of dying and finishing and should not exceed 300 degrees Fahrenheit. In certain embodiments, the step of fabric fixation and sizing is performed after scouring and before dying.

Fabric fixation and sizing may be under any possible conditions of stretch and tension, timing, duration, and width settings; however, heat level should not exceed 300 degrees Fahrenheit.

Width sizing settings will depend on the original machine size. In certain embodiments, fabric width of the first fabric material on the machine take-up is 155 cm-160 cm, and sizing is set to 160 cm-165 cm final width.

In certain embodiments of the invention, the final first fabric material weight is between 200 GSM and 210 GSM (Gram per Square Meter) measured on relaxed fabric per industry standard.

In certain embodiments of the invention, the final maximum stretch of the fabric may reach at least 120% in the knitting direction and 80% the sideway direction.

In certain embodiments of the invention, the first fabric material is not the same as the second fabric material.

ii. Outer Shell

The second fabric material that defines the outer shell serves as the outer layer of the functionally supportive pillow of the present invention.

In certain embodiments of the invention, the second fabric material is circular knitted fabric.

Yarns that comprise the second fabric material can be of any kind of knitting yarns from any material of any thickness in any combinations, mixtures and ratios. In certain embodiments, the first material comprises 30 Nec (English count) fine grade combed cotton and 70 Denier (78 DTex) Spandex, e.g., Lycra® by DuPont. The yarn mix and materials mix can be of any possible kind and ratios, e.g., 88.5% Cotton and 11.5% Lycra® Spandex (about 89% cotton 11% spandex).

In certain embodiments of the invention, the second fabric material is created/knitted on any diameter circular knitting machine of any sort (i.e. single jersey, rib, tricot etc) and any patterning setups, cam combination, number of needle tracks, number of feeders, yarn tension controls, as well as Jacquard patterning of any kind at any Gage (needle density). In a particular embodiment, the second fabric material is knitted on 30" diameter machine at 28 Gage single jersey, 2640 or 2660 needles with dedicated adjustable spandex feeders.

In an alternative embodiment of the invention, the second fabric material is produced on a 24 Gage machine, e.g., using 24 Nec Cotton Yarn count and 70 Denier Lycra at 91.5%/8.5% ratio, respectively.

The yarn consumption can be set to any possible setting that the mentioned machines will allow. In certain embodiments, the cotton eye length is 2.7 mm and the spandex eye length is 0.88 mm. Consumption may be calculated based on number of needles in the machine as mentioned above and as multiplication of the number of needles by the eye length, and measured as meters per turn.

In certain embodiments of the invention, the first fabric material comprises a yarn mix ratio of 88.5% Cotton yarn and 11.5% Spandex yarn.

In certain embodiments of the invention, the outer shell is shaped into pre-defined form by stitching.

In certain embodiments of the invention, the outer shell comprises a zipper.

In certain embodiments of the invention, the outer shell is machine washable

In certain embodiments of the invention, the outer shell may be selected from a range of colors, e.g., cream, pink, red, burgundy, orange, yellow caramel, Celtic green, green, turquoise, blue, bright purple, purple, black, dark gray, light gray, or brown.

The second fabric material may be dyed by any available dyestuff, for example, reactive dyes, in any formulas and combinations and any possible processes and to any color on any dying equipment.

In certain embodiments, finishing of the second fabric material by treatment to functionalize the second fabric material may comprise one or more chemical treatments, such as an antimicrobial agent, an anti-molding agent, an anti-static charge agent, a mosquito repellant, SCOTCH GUARD® fabric protector, a softener, and a UV resistance agent. In certain embodiments, gentle methods are utilized. In certain embodiments, the dying process does not involve jet dying machines.

In certain embodiments of the invention, the second material consists of one or more synthetic fibers, e.g., Tricot fabric. In particular embodiments of the invention, the second fabric material is same as first fabric material. In particular embodiments of the invention, the second fabric material is laminated. The second fabric material may be laminated with any suitable lamination materials, e.g., PU (Polyurethane) or TPU (Thermoplastic Polyurethane) film and/or liquid of any formula similar to Argotec TX1540 products with similar properties (see Table 1). The lamination may be applied by heat and/or by adhesives of any kind, e.g., bonded by heat, or water-based or solvent-based adhesives, e.g., polyurethane adhesives consist of a high molecular weight hydroxyl terminated polyurethane dissolved in a solvent, with or without isocyantes such as toluene diisocyanate (TDI) and diphenylmethane isocyanate (MDI) to avoid discoloration and deterioration of mechanical properties of the adhesive and/or combine antioxidant and UV absorbers for stabilization.

The laminated film may be any thickness, e.g., 1-1.5 mils.

In certain embodiments of the invention, the second fabric material is laminated with a Polyurethane or Thermoplastic Polyurethane film.

In certain embodiments of the invention, the thickness of laminated film is 1-1.5 mils.

In certain embodiments of the invention, the laminated second material is treated to functionalize the material. In certain embodiments, the laminated second material is treated to functionalize the material with an agent selected from one or more of the group consisting of a flame retardant, an antimicrobial agent, an anti-molding agent, an anti-static charge agent, a mosquito repellant, SCOTCH GUARD® fabric protector, a softener, and a UV resistance agent. In particular embodiments, the laminated second material is treated to functionalize the material with a flame retardant, e.g., Pyrovatex SVC®.

In the preparation of the second fabric material for the inner core, the step of fabric fixation and sizing is performed, e.g., at any stage in the process of dying and finishing and should not exceed 300 degrees Fahrenheit. In certain embodiments, the step of fabric fixation and sizing is performed after scouring and before dying.

Fabric fixation and sizing may be under any possible conditions of stretch and tension, timing, duration, and width settings; however, heat level should not exceed 300 degrees Fahrenheit.

Width sizing settings will depend on the original machine size. In certain embodiments, fabric width of the second fabric material is sized to the width of 160 cm for 45 seconds at 190 degrees Celsius. In particular embodiments, the second fabric material is finished with hydrophobic silicon for water and oil repellency.

In certain embodiments of the invention, the second fabric material weight prior to dying or finishing (cut and weighed directly from the knotting machine) will be about 260 GSM (Gram per Square Meter).

In certain embodiments of the invention, the final second fabric material weight is between 280 GSM and 300 GSM (Gram per Square Meter) measured on relaxed fabric per industry standard.

In certain embodiments of the invention, the final maximum stretch of the fabric may reach at least 100%.

iii. Bead Material

The bead material is contained within the inner core and comprises rounded particulates of polymeric foam capable of free flowing movement in the absence of constant pressure applied to the pillow.

In certain embodiments of the invention, the bead material fills greater than 80% of the maximum volume of the inner core.

In certain embodiments of the invention, the bead material fills greater than 90% of the maximum volume of the inner core.

In certain embodiments of the invention, the bead material particulates range from 0.5 mm to 5 mm in diameter, e.g., and may be a mix of sizes.

In certain embodiments of the invention, the bead material particulates are expanded polystyrene (EPS) STYROFOAM® EPS beads, e.g., industry standard EPS beads. The size of the beads can be at any size, e.g., 0.5 mm to 5 mm, and may be a mix of sizes. Known industry sizes are Type B and Type C beads, each of which may be used herein.

III. Method of Preparation of Functionally Supportive Pillows of the Invention In another embodiment, the present invention provides a method of preparation of a functionally supportive pillow of the present invention comprising the steps of selecting a dynamically responsive combination of an inner core enclosing a bead material and an outer shell, wherein (a) the inner core is defined by a first fabric material shaped into a pre-defined form capable of enclosing the bead material, wherein said first fabric consisting of one or more synthetic fibers engineered to be stretchy and durable, which may be optionally treated to functionalize;

(b) the outer shell is defined by a second fabric shaped to contain the inner core enclosing the bead material, wherein said second fabric comprises one or more fibers engineered to be stretchy and durable;

(c) the bead material comprises a plurality of rounded particulates of polymeric foam capable of free flowing movement in the absence of constant pressure applied to the pillow;

obtaining the inner core, the bead material, and the outer shell;

enclosing the bead material inside the inner core; and disposing the inner core inside of the outer shell, such that a functionally supportive pillow is prepared wherein the combination of the inner core with the outer shell creates a dynamic response to applied pressure to the pillow for increased functional support of said pillow.

In another embodiment, the present invention provides a method of preparation of an environmentally resistant (ER) functionally supportive pillow of the present invention comprising the steps of selecting a dynamically responsive combination of an inner core enclosing a bead material and an outer shell, wherein (a) the inner core is defined by a first fabric material shaped into a pre-defined form capable of enclosing the bead material, wherein said first fabric consisting of one or more synthetic fibers engineered to be stretchy and durable, which may be optionally treated to functionalize;

(b) the outer shell is defined by a laminated second fabric shaped to contain the inner core enclosing the bead material, wherein said second fabric comprises one or more synthetic fibers engineered to be stretchy and durable, which may be optionally treated to functionalize;

(c) the bead material comprises a plurality of rounded particulates of polymeric foam capable of free flowing movement in the absence of constant pressure applied to the pillow;

obtaining the inner core, the bead material, and the outer shell;

enclosing the bead material inside the inner core; and disposing the inner core inside of the outer shell, such that a functionally supportive pillow is prepared wherein the combination of the inner core with the outer shell creates a dynamic response to applied pressure to the pillow for increased functional support of said pillow.

In another embodiment, the present invention provides a method of preparation of a multi-core (MC) functionally supportive pillow of the present invention comprising the steps of selecting a dynamically responsive combination of two or more inner cores enclosing a bead material and an outer shell, wherein (a) the inner cores are defined by a first fabric material shaped into a pre-defined form capable of enclosing the bead material, wherein said first fabric consisting of one or more synthetic fibers engineered to be stretchy and durable, which may be optionally treated to functionalize;

(b) the outer shell is defined by a second fabric shaped to contain the inner core enclosing the bead material, wherein said second fabric comprises one or more fibers engineered to be stretchy and durable, which may be optionally treated to functionalize;

(c) the bead material comprises a plurality of rounded particulates of polymeric foam capable of free flowing movement in the absence of constant pressure applied to the pillow;

obtaining the inner core, the bead material, and outer shell;

enclosing the bead material inside the inner core; and disposing the inner core inside of the outer shell, such that a functionally supportive pillow is prepared wherein the combination of the inner core with the outer shell creates a dynamic response to applied pressure to the pillow for increased functional support of said pillow.

In certain embodiments of the invention, the step of obtaining the inner core comprises preparing the inner core. In particular embodiments, the step of preparing the inner core comprises one or more of the following processes, e.g., as described herein: knitting, scouring, fixation, sizing, dying, and/or finishing. In certain embodiments, finishing may include printing, coating, fire retardant treatment, anti-microbial treatment, anti mold treatment, SCOTCH GUARD® fabric protector treatment, brushing, sanding, packaging in rolling, or lagging.

In certain embodiments of the invention, the step of obtaining the bead material comprises preparing the bead material. In particular embodiments, the step of preparing the bead material comprises manufacture of EPS STYROFOAM® EPS beads, e.g., by any commercially known method.

In certain embodiments of the invention, the step of obtaining the outer shell comprises preparing the outer shell. In particular embodiments, the step of preparing the outer shell comprises one or more of the following processes, e.g., as described herein: knitting, scouring, fixation, sizing, dying, and/or finishing. In certain embodiments, finishing may include printing, coating, fire retardant treatment, antimicrobial treatment, anti mold treatment, SCOTCH GUARD® fabric protector treatment, brushing, sanding, packaging in rolling, or lagging.

INCORPORATION BY REFERENCE

The entire contents of all patents, published patent applications and other references cited herein are hereby expressly incorporated herein in their entireties by reference.

EQUIVALENTS

Those skilled in the art will recognize, or be able to ascertain using no more than routine experimentation, numerous equivalents to the specific procedures described herein. Such equivalents were considered to be within the scope of this invention and are covered by the following claims. Moreover, any numerical or alphabetical ranges provided herein are intended to include both the upper and lower value of those ranges. In addition, any listing or grouping is intended, at least in one embodiment, to represent a shorthand or convenient manner of listing independent embodiments; as such, each member of the list should be considered a separate embodiment.

What is claimed is:

1. A functionally supportive pillow comprising a dynamically responsive combination of an inner core enclosing a bead material and an outer shell, wherein (a) the inner core is defined by a first fabric material shaped into a pre-defined form capable of enclosing the bead material, wherein said first fabric consists of one or more synthetic fibers engineered to be stretchy and durable, which may be optionally treated to functionalize;

(b) the outer shell is defined by a second fabric shaped to contain the inner core enclosing the bead material, wherein said second fabric comprises one or more fibers engineered to be stretchy and durable;

(c) the bead material comprises a plurality of rounded particulates of polymeric foam capable of free flowing movement in the absence of constant pressure applied to the pillow, and wherein the inner core is disposed directly inside of the outer shell, such that the combination of the inner core with the outer shell creates a dynamic response to applied pressure to the pillow for increased functional support of said pillow, rigidifying the bead material enclosed in the inner core in response to the application of the pressure to the pillow, and returning the bead material to free flowing in the absence of the pressure.

2. The functionally supportive pillow of claim 1, wherein the pillow achieves 70-80% of body conformation.

3. The functionally supportive pillow of claim 1, wherein the functionally supportive pillow is highly durable upon application of repeated applied pressure.

4. The functionally supportive pillow of claim 1, wherein the bead material particulates are EPS beads.

5. The functionally supportive pillow of claim 1, wherein the first fabric material is non-circular knitted fabric.

6. The functionally supportive pillow of claim 5, wherein the first fabric material is tricot fabric.

7. The functionally supportive pillow of claim 6 wherein the first fabric material comprises a yarn mix ratio of 92% Polyester yarn and 8% Lycra Spandex yarn.

8. The functionally supportive pillow of claim 1, wherein the first fabric material is treated to functionalize the material.

9. The functionally supportive pillow of claim 8, wherein the first fabric material is treated to functionalize the material with an agent selected from one or more of the group consisting of a flame retardant, an antimicrobial agent, an anti-molding agent, an anti-static charge agent, a mosquito repellant, SCOTCH GUARD® fabric protector, a softener, and a UV resistance agent.

10. The functionally supportive pillow of claim 1, wherein the second fabric material is circular knitted fabric.

11. The functionally supportive pillow of claim 1, wherein the second fabric material comprises a yarn mix ratio of 88.5% Cotton yarn and 11.5% Spandex yarn.

12. An environmentally resistant (ER) functionally supportive pillow comprising a dynamically responsive combination of an inner core enclosing a bead material and an outer shell, wherein (a) the inner core is defined by a first fabric material shaped into a pre-defined form capable of enclosing the bead material, wherein said first fabric consisting of one or more synthetic fibers engineered to be stretchy and durable, which may be optionally treated to functionalize;

(b) the outer shell is defined by a laminated second fabric shaped to contain the inner core enclosing the bead material, wherein said second fabric comprises one or more synthetic fibers engineered to be stretchy and durable, which may be optionally treated to functionalize;

(c) the bead material comprises a plurality of rounded particulates of polymeric foam capable of free flowing movement in the absence of constant pressure applied to the pillow, and wherein the inner core is disposed directly inside of the outer shell, such that the combination of the inner core with the outer shell creates a dynamic response to applied pressure to the pillow for increased functional support of said pillow, rigidifying the bead material enclosed in the inner core in response to the application of the pressure to the pillow, and returning the bead material to free flowing in the absence of the pressure.

13. The functionally supportive pillow of claim 12, wherein the second fabric material is laminated with a Polyurethane or Thermoplastic Polyurethane film.

14. The functionally supportive pillow of claim 12, wherein the thickness of laminated film is 1-1.5 mils.

15. The functionally supportive pillow of claim 12, wherein the pillow achieves 60-70% of body conformation.

16. The functionally supportive pillow of claim 12, wherein the bead material particulates are EPS beads.

17. The functionally supportive pillow of claim 12, wherein the first fabric material or second fabric is treated to functionalize the material.

18. A multi-core (MC) functionally supportive pillow comprising a dynamically responsive combination of two or more inner cores enclosing a bead material and an outer shell, wherein (a) the inner cores are each defined by a first fabric material shaped into a pre-defined form capable of enclosing the bead material, wherein said first fabric consisting of one or more synthetic fibers engineered to be stretchy and durable, which may be optionally treated to functionalize;

(b) the outer shell is defined by a second fabric shaped to contain all inner cores enclosing the bead material, wherein said second fabric comprises one or more fibers engineered to be stretchy and durable;

(c) the bead material comprises a plurality of rounded particulates of polymeric foam capable of free flowing movement in the absence of constant pressure applied to the pillow, and wherein the inner cores is disposed directly inside of the outer shell, such that the combination of the inner cores with the outer shell creates a dynamic response to applied pressure to the pillow for increased functional support of said pillow, rigidifying the bead material enclosed in the inner core in response to the application of the pressure to the pillow, and returning the bead material to free flowing in the absence of the pressure.

19. The functionally supportive pillow of claim 18, wherein the pillow achieves 70-80% of body conformation.

20. The functionally supportive pillow of claim 18, wherein the bead material particulates are EPS beads.

* * * * *